US007081037B2

(12) United States Patent
Berman et al.

(10) Patent No.: US 7,081,037 B2
(45) Date of Patent: Jul. 25, 2006

(54) PAD CONDITIONER SETUP

(75) Inventors: Michael J. Berman, West Linn, OR (US); Jan Fure, Portland, OR (US)

(73) Assignee: LSI Logic Corporation, Milpitas, CA (US)

( * ) Notice: Subject to any disclaimer, the term of this patent is extended or adjusted under 35 U.S.C. 154(b) by 346 days.

(21) Appl. No.: 10/668,021

(22) Filed: Sep. 22, 2003

(65) Prior Publication Data

US 2005/0064792 A1 Mar. 24, 2005

(51) Int. Cl.
*B24B 1/00* (2006.01)

(52) U.S. Cl. ..... 451/5; 451/41; 451/6; 451/451; 451/8

(58) Field of Classification Search ..... 451/5, 451/6, 8, 10, 41, 56, 285–289; 700/301; 438/692
See application file for complete search history.

(56) References Cited

U.S. PATENT DOCUMENTS 4,003,245 A * 1/1977 Ogata et al. ..... 73/800
4,184,365 A * 1/1980 Webster ..... 73/146
6,477,447 B1 * 11/2002 Lin ..... 700/301
6,722,948 B1 * 4/2004 Berman ..... 451/21

FOREIGN PATENT DOCUMENTS

JP 2001-337533 * 11/2000

* cited by examiner

*Primary Examiner*—M. Rachuba
(74) *Attorney, Agent, or Firm*—Luedeka, Neely & Graham, P.C.

(57) ABSTRACT

A method for inspecting the uniformity of the pressure applied between a conditioner and a polishing pad on a chemical mechanical polisher. A sheet of pressure sensitive material is placed between the conditioner and the polishing pad, and the conditioner is lowered onto the sheet of pressure sensitive material. A desired degree of pressure is applied between the conditioner and the polishing pad, thereby creating an impression in the sheet of pressure sensitive material, and the conditioner is lifted from the sheet of pressure sensitive material. The sheet of pressure sensitive material is inspected to determine the uniformity of the pressure applied between the conditioner and the polishing pad.

11 Claims, 1 Drawing Sheet

PAD CONDITIONER SETUP

FIELD

This invention relates to the field of integrated circuit fabrication. More particularly, this invention relates to improving the uniformity and other process characteristics of chemical mechanical polishing of integrated circuits.

BACKGROUND

As integrated circuits have become smaller, they have shrunk not only in the amount of surface area required, but also in the thicknesses of the various layers by which they are formed. As the thicknesses of the layers has decreased, it has become increasingly important to planarize a given layer prior to forming a subsequent overlying layer. One of the methods used for such planarization is called chemical mechanical polishing. During chemical mechanical polishing, the surface of the layer to be planarized, thinned, or both is brought into contact with the surface of a polishing pad. The pad and the substrate are rotated and translated relative to each other in the presence of a polishing fluid, which typically contains both physical erosion particles and chemical erosion compounds. Because of the thinness of the layers and the tight tolerances desired, it is important to have a relatively high degree of control over the chemical mechanical polishing process.

One method by which control of the chemical mechanical polishing process is maintained is called conditioning. During conditioning, an implement called a conditioner is brought into contact with the surface of the pad. The conditioner is intended to erode the surface of the pad, so as to expose a portion of the pad that is presumptively more uniform and clean. Conditioning the pad may be accomplished either between substrate polishing processes, or concurrently with the polishing process. Conditioning tends to generally improve important process characteristics such as substrate to substrate repeatability, polish rate stability, pad life, down time, and overall cost of system ownership.

Because the conditioner performs such an important function, it is commensurately important to ensure that the conditioner is functioning properly. Such methods have in the past included a visual inspection of the conditioner, a "fish scale" force monitor, removing the conditioner and performing a flatness test against a known flat standard, and regularly rebuilding or replacing the conditioner. If the conditioner is miss-aligned, worn out, or warped, then it might not make complete and uniform contact with the pad. Such poor pad conditioning might result in poor processing uniformity across a substrate or from substrate to substrate, shorter pad life, increased down time, and other expenses due to yield loss.

Unfortunately, it is very difficult to detect whether the pad conditioner is performing properly, except by the dramatic indicators given above, such as short pad life and wafer non uniformity. Thus, in an extreme condition, a pad conditioner may need to be removed and completely set up anew each day, to ensure that it is in good condition and operating properly. However, this is an expensive and time-consuming process, and opens the door for mistakes to be made during the frequently repeated set up process.

What is needed, therefore, is a system by which proper operation of the pad conditioner can be more readily determined.

SUMMARY

The above and other needs are met by a method for inspecting the uniformity of the pressure applied between a conditioner and a polishing pad on a chemical mechanical polisher. A sheet of pressure sensitive material is placed between the conditioner and the polishing pad, and the conditioner is lowered onto the sheet of pressure sensitive material. A desired degree of pressure is applied between the conditioner and the polishing pad, thereby creating an impression in the sheet of pressure sensitive material, and the conditioner is lifted from the sheet of pressure sensitive material. The sheet of pressure sensitive material is inspected to determine the uniformity of the pressure applied between the conditioner and the polishing pad.

In this manner, the uniformity of the pressure applied between the conditioner and the polishing pad can be determined in a simple, quick, and inexpensive manner. Further, the method is applicable to a wide range of chemical mechanical polishers, and does not require expensive or specialized equipment in order to be of use with any such. In addition, the method provides for the recordation of a history of the condition of the chemical mechanical polisher, by keeping the sheets of pressure sensitive material with the impressions.

In various embodiments, the method includes correcting the sources of any non-uniformities detected in the pressure applied between the conditioner and the polishing pad. Preferably, the step of inspecting the sheet of pressure sensitive material is a visual inspection. The impression preferably indicates that a pressure threshold has been exceeded. In various embodiments, the impression exhibits varying degrees of a single characteristic of indication based upon varying degrees of pressure applied between the conditioner and the polishing pad. Alternately, the impression exhibits multiple characteristics of indication based upon varying degrees of pressure applied between the conditioner and the polishing pad. Further, the impression may exhibit varying colors based upon varying degrees of pressure applied between the conditioner and the polishing pad.

In a most preferred embodiment, the step of inspecting the sheet of pressure sensitive material to determine the uniformity of the pressure applied between the conditioner and the polishing pad includes optically scanning and digitizing the impression on the sheet of pressure sensitive material, and comparing the scanned and digitized impression to a database of scanned and digitized impressions. The method also preferably includes the steps of optically scanning and digitizing the impression on the sheet of pressure sensitive material, associating with the scanned and digitized impression data in regard to conditions of the chemical mechanical polisher at a time that the impression was created, and storing the scanned and digitized impression and associated data in a database.

According to another aspect of the invention there are describes methods for inspecting the uniformity of pressure applied between a substrate effecter and a polishing pad on a chemical mechanical polisher, which are similar to the methods described above.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
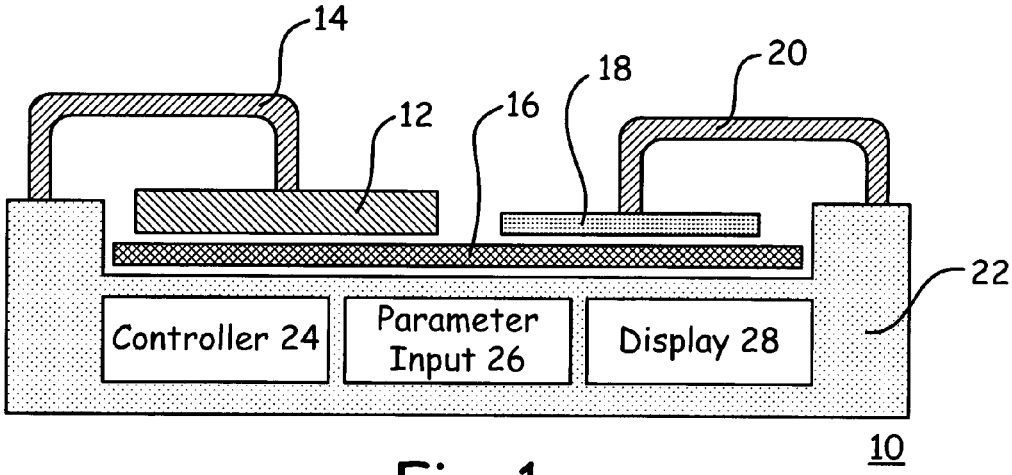
FIG. 1 is a functional schematic of a chemical mechanical polisher according to the present invention, including a conditioner.

With reference now to FIG. 1, there is depicted a functional schematic of a chemical mechanical polisher 10 according to the present invention, including a conditioner 12. The conditioner 12 abrades the surface of a rotating polishing pad 16 in a controlled manner, thus conditioning the polishing pad 16. The conditioner 12 is forced against the pad 16 such as by an armature 14, which preferably sweeps the conditioner 12 across the surface of the pad 16. A substrate 18 is polished against the pad 16, under the control of an effecter 20. The polishing of the substrate 18 may be either concurrent or alternating with the use of the conditioner 12.

The conditioner 12 may be formed in any one of a number of different configurations. For example, in one embodiment the conditioner 12 is formed in the shape of a bar. In alternate embodiments, the conditioner 12 is formed in the shape of a disk. A disk-shaped conditioner 12 may be either solid like a circle or hollow like a doughnut. The conditioner may take other shapes as well, such as other geometrically shaped surface areas. It is appreciated that the conditioner 12 may also be formed in various sizes, such as the size presented in FIG. 1, where it is about half of the diameter of the polishing pad, or in larger or smaller sizes. Thus, the embodiments as depicted in the figures are representative only in regard to the exact shape and size of the conditioner 12.

A housing 22 contains mechanical and electrical controls for the polisher 10, which preferably operates under the control of a controller 24. An operator can input commands and other parameters into the polisher 10 such as by the input 26. Information in regard to the processing is preferably presented on the display 28. One or more of the controller 24, input 26, and display 28 may be either located within the housing 22 of the system 10 as depicted in FIG. 1, or may be remotely connected to the main unit 22, such as by a computer network. The controller 24 is preferably programmable, such as through the input 26, to control the amount of force applied through the conditioner 12. Such control can be accomplished such as by applying more or less force, as desired, through the armature 14.

As mentioned above, it is desirable to condition the pad 16 with the conditioner 12 in a uniform and well controlled manner. Thus, it is desirable to engage the conditioner 12 against the surface of the pad 16 with a known and repeatable force, and also with a force that is known and preferably uniform across the conditioner 12. Because of the conditions mentioned above, the knowledge and control of such forces is typically not easily had.

Figure 2:
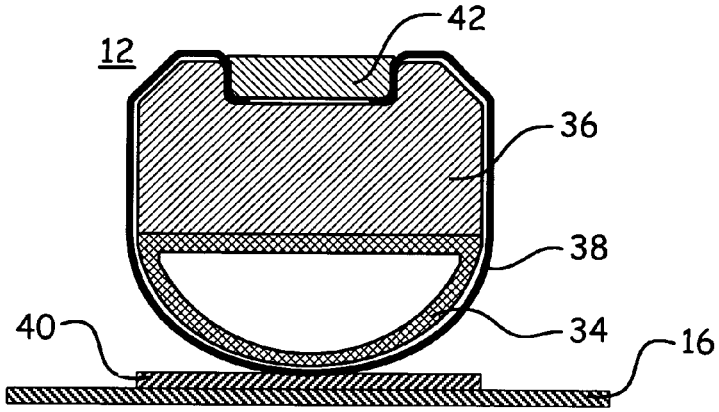
FIG. 2 is a cross sectional view of the conditioner in contact with the pressure sensitive film, according to the present invention.

FIG. 2 is a cross sectional view of the conditioner 12. A rigid member 36 preferably forms the structural portions of the conditioner 12. The rigid member 36 is preferably formed of a relatively rigid material, such as a metal, hard thermoset plastic, or ceramic material. The rigid member 36 is most preferably clad with a conditioning pad 38, such as a diamond impregnated pad, which is the portion of the conditioner 12 which contacts the pad 16. The pad 38 is preferably retained against the rigid member 36 such as with a retaining block 42, which is releasably affixed to the member 36.

Disposed along the bottom edge of the rigid member 36 there is depicted a compression member 34. The compression member 34 preferably deforms and flattens to some degree under the force that is applied through the conditioner 12 to the pad 16. In a preferred embodiment, the compression member 34 is configured as a hollow, formed rubber tube that runs along the length of the bottom of the rigid member 36. Thus, as pressure is applied to the polishing pad 16 by the conditioner 12, each portion of the hollow tube along the length of the compression member 34 flattens out to a degree that is dependent upon the amount of force that is exerted on that portion of the compression member 34.

During operation and use of the conditioner 12, the pad 38 is brought in to contact with the polishing pad 16, and a given amount of force is applied, such as is programmed through the controller 24 and applied through the armature 14. When this is done, the polishing pad 16 tends to deform somewhat under the pressure exerted through the conditioner 12. Thus, the polishing pad 16 tends to deform in this manner regardless of whether the conditioner 12 includes a compression member 34. However, as mentioned above, many embodiments of a conditioner 12 include the deformable compression member 34, which also tends to deform and flatten somewhat under the applied pressure. This relative compression, flattening, and other deformation at the interface between the conditioner 12 and the polishing pad 16 is advantageously used in the present invention.

As a part of the method according to the present invention, a pressure sensitive device, such as a sheet of pressure sensitive material 40, is placed on the surface of the polishing pad 16. The conditioner 12 is then moved over and aligned to the sheet of pressure sensitive material 40, and then lowered into contact with the sheet of pressure sensitive material 40 with the programmed amount of force. The conditioner 12 is then raised and moved out of the way, and the sheet of pressure sensitive material 40 is removed from the polishing pad 16 and inspected.

Preferably, the sheet of pressure sensitive material 40 is of a type the exhibits a visible modification based upon the amount of pressure that is applied to it. Thus, the inspection of the sheet of pressure sensitive material 40 is most preferably a visual inspection. For example, the sheet of pressure sensitive material 40 may experience a color change when a pressure that is greater than a given threshold is applied to it. Alternately, the sheet of pressure sensitive material 40 may exhibit varying degrees of color change, or changes of different colors, as varying degrees of pressure are applied to it. One product that can be used as the sheet of pressure sensitive material 40 is offered by Sensor Products Inc. of East Hanover, N.J., under the trade name of PRESSUREX MICRO MATS.

The visual inspection of the sheet of pressure sensitive material 40 can be accomplished with the naked eye, or more preferably is accomplished in a more automated, accurate, and repeatable manner, such as optically scanning and digitizing the image of the sheet of pressure sensitive material 40, and using a computer to compare the current image formed in the sheet of pressure sensitive material 40 to a database of previously scanned images. Such a database could include associated data with each image, such as the amount of force that was applied, and the results of substrate polishing that was accomplished using the settings and other conditions that existed at the time that the associated image was produced.

Figure 3:
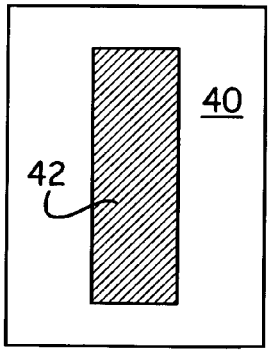
FIG. 3 is a top plan view of a uniform imprint of the conditioner on the pressure sensitive film.

For example, FIG. 3 depicts an impression 42 on the sheet of pressure sensitive material 40, formed from the pressure applied between the conditioner 12 and the polishing pad 16, in the manner as described above. In the example depicted in FIG. 3, the sheet of pressure sensitive material 40 only indicates whether a give pressure threshold has been attained in a given location on the sheet of pressure sensitive material 40. However, as mentioned above, it is appreciated that other indicator options could also be used, and the present embodiment is used for ease in describing the present invention, and not by way of limitation.

Figure 4:
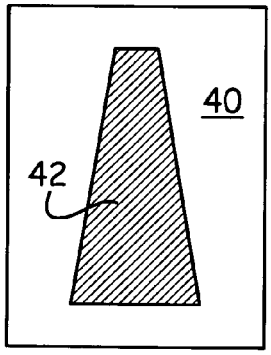
FIG. 4 is a top plan view of a non-uniform imprint of the conditioner on the pressure sensitive film.

As can be seen in FIG. 3, the impression 42 is highly uniform, with straight, parallel edges. Such an impression 42 tends to indicate that the pressure along the length of the conditioner 12 was highly uniform, and that the degree of deformation of either or both of the compression member 34 and the polishing pad 16 was therefore also quite uniform. This is a generally desirable condition. By contrast, FIG. 4 depicts an impression 42 in the sheet of pressure sensitive material 40, where the edges are not parallel, and where the impression 42 is much wider at one end than it is at the other. Such an impression 42 tends to generally indicate that the degree of deformation of either or both of the compression member 34 and the polishing pad 16 was not uniform, but rather was relatively greater at the end of the impression 42 that is broader than the other. This tends to indicate the pressure exerted at that broad end was greater than the pressure exerted at the narrower end. This is generally an undesirable condition.

Thus, by inspecting the sheet of pressure sensitive material 40 in this manner, a great deal of information can be determined about the present condition of the chemical mechanical polisher 10, and if any problems are detected, they can be corrected prior to jeopardizing the yield of the substrates that will be processed with the chemical mechanical polisher 10. It is appreciated that this same technique can be applied to an investigation of the force applied by the effecter 18.

It is appreciated that the impressions 42 on the sheet of pressure sensitive material 40 can vary widely, and contain a great deal of information. For example, if the edges of the impression 42 are wavy, then it may indicate that edge or other sections of the compression member 34 are worn in a non-uniform manner. If a portion in the center of the impression 42 has not made uniform pressure contact, then it may indicate that the center or other section of the compression member 34 is worn in a non-uniform manner. Further, if the ends of the impression 42 are uniform, but between the ends the edges of the impression 42 are bent in or out, or to one side or the other, then it may be an indication that the rigid member 36 of the conditioner 12 is bowed or bent, or flexing during application of the conditioner 12.

Such irregularities in the shape of the impression 42 are preferably stored in a database with associated information, as described above, so that they can be used for comparison with new impressions 42, and used as diagnostic aids for problems and issues may occur with the chemical mechanical polisher 10. In this manner, the condition of the chemical mechanical polisher 10 can be rapidly investigated, and the problems diagnosed and fixed, without resorting to time-consuming and expensive alternative measures. Further, and such conditions can be corrected prior to committing substrates to the chemical mechanical polisher 10.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A method for inspecting a uniformity of pressure applied between a conditioner and a polishing pad on a chemical mechanical polisher, the method comprising the steps of:

placing a sheet of pressure sensitive material between the conditioner and the polishing pad, lowering the conditioner onto the sheet of pressure sensitive material, applying a desired degree of pressure between the conditioner and the polishing pad, thereby creating an impression in the sheet of pressure sensitive material, lifting the conditioner from the sheet of pressure sensitive material, and inspecting the sheet of pressure sensitive material to determine the uniformity of the pressure applied between the conditioner and the polishing pad.

2. The method of claim 1, further comprising the step of correcting sources of any non-uniformities detected in the pressure applied between the conditioner and the polishing pad.

3. The method of claim 1, wherein the step of inspecting the sheet of pressure sensitive material comprises a visual inspection.

4. The method of claim 1, wherein the impression indicates that a pressure threshold has been exceeded.

5. The method of claim 1, wherein the impression exhibits varying degrees of a single characteristic of indication based upon varying degrees of pressure applied between the conditioner and the polishing pad.

6. The method of claim 1, wherein the impression exhibits multiple characteristics of indication based upon varying degrees of pressure applied between the conditioner and the polishing pad.

7. The method of claim 1, wherein the impression exhibits varying colors based upon varying degrees of pressure applied between the conditioner and the polish pad.

8. The method of claim 1, wherein the step of inspecting the sheet of pressure sensitive material to determine the uniformity of the pressure applied between the conditioner and the polishing pad further comprises:

optically scanning and digitizing the impression on the sheet of pressure sensitive material, and comparing the scanned and digitized impression to a database of scanned and digitized impressions.

9. The method of claim 1, further comprising the steps of:

optically scanning and digitizing the impression on the sheet of pressure sensitive material.

associating with the scanned and digitized impression data in regard to conditions of the chemical mechanical polisher at a time that the impression was created, and storing the scanned and digitized impression and associated data in a database.

10. A method for inspecting a uniformity of pressure applied between a conditioner and a polishing pad on a chemical mechanical polisher, the method comprising the steps of:

placing a sheet of pressure sensitive material between the conditioner and the polishing pad, lowering the conditioner onto the sheet of pressure sensitive material, applying a desired degree of pressure between the conditioner and the polishing pad, thereby creating an impression in the sheet of pressure sensitive material, lifting the conditioner from the sheet of pressure sensitive material, inspecting the sheet of pressure sensitive material to determine the uniformity of the pressure applied between the conditioner and the polishing pad, by optically scanning and digitizing the impression on the sheet of pressure sensitive material, and comparing the scanned and digitized impression to a database of scanned and digitized impressions, and correcting sources of any non-uniformities detected in the pressure applied between the conditioner and the polishing pad.

11. The method of claim 10, further comprising the steps of:

associating with the scanned and digitized impression data in regard to conditions of the chemical mechanical polisher at a time that the impression was created, and storing the scanned and digitized impression and associated data in the database.

* * * * *